US006848368B2

(12) United States Patent
Leith

(10) Patent No.: US 6,848,368 B2
(45) Date of Patent: Feb. 1, 2005

(54) STAND DEVICE

(75) Inventor: John Russ Leith, Bedfordshire (GB)

(73) Assignees: Leith John Russ, Shefford Bedfordshire (GB); Tim Shepard, South Ealing London (GB)

( * ) Notice: Subject to any disclaimer, the term of this patent is extended or adjusted under 35 U.S.C. 154(b) by 0 days.

(21) Appl. No.: 10/250,853

(22) PCT Filed: Jan. 9, 2002

(86) PCT No.: PCT/GB02/00060

§ 371 (c)(1),
(2), (4) Date: Jul. 1, 2003

(87) PCT Pub. No.: WO02/054909

PCT Pub. Date: Jul. 18, 2002

(65) Prior Publication Data

US 2004/0060484 A1 Apr. 1, 2004

(30) Foreign Application Priority Data

Jan. 12, 2001 (GB) ..... 0100815

(51) Int. Cl.[7] ..... A47B 23/00
(52) U.S. Cl. ..... 108/42
(58) Field of Search ..... 108/96, 97, 42, 108/48, 147.11, 147.13, 147.15, 147.17, 152, 91, 92, 93

(56) References Cited

U.S. PATENT DOCUMENTS

| | | | | | |
|---|---|---|---|---|---|
| 1,964,124 | A | * | 6/1934 | Keller | 108/96 |
| 1,984,602 | A | | 12/1934 | Snyder | |
| 2,457,373 | A | | 12/1948 | Hunter | |
| 2,649,972 | A | * | 8/1953 | Weil | 108/147.11 |
| 2,791,476 | A | * | 5/1957 | Atwill | 108/45 |
| 2,898,170 | A | | 8/1959 | Antonius | |
| 3,104,625 | A | * | 9/1963 | Conley | 108/96 |
| 3,906,872 | A | | 9/1975 | Erickson | |
| 3,976,015 | A | * | 8/1976 | Mc Murray | 108/92 |
| 4,760,800 | A | * | 8/1988 | Hanson | 108/190 |
| 5,088,420 | A | * | 2/1992 | Russell | 108/106 |
| 5,115,924 | A | * | 5/1992 | Konig | 211/186 |
| 5,183,167 | A | * | 2/1993 | Cheng | 211/187 |
| 5,188,424 | A | * | 2/1993 | Herron | 297/195.1 |
| D364,763 | S | * | 12/1995 | Sielaff | D6/479 |
| 5,477,789 | A | | 12/1995 | Von Gunten | |
| 5,638,966 | A | | 6/1997 | Kuntz | |
| 5,642,675 | A | * | 7/1997 | Webb | 108/48 |
| 5,802,987 | A | * | 9/1998 | Bellak et al. | 108/108 |
| 6,240,857 | B1 | * | 6/2001 | Elizer | 108/152 |

FOREIGN PATENT DOCUMENTS

| | | |
|---|---|---|
| DE | 297 23 247 A1 | 11/1998 |
| JP | 8-33528 A1 | 2/1996 |
| JP | 2001-112672 A1 | 4/2001 |
| WO | WO-96/15697 A1 | 5/1997 |

* cited by examiner

*Primary Examiner*—Jose V. Chen
(74) *Attorney, Agent, or Firm*—Darby & Darby

(57) ABSTRACT

A shelf or stand device comprises at least one platform member and at least one rod like elongated leg member. An aperture in the platform member is shaped to allow the passage therethrough of the leg member. Contact between the platform member and an adjacent wall or walls of a room in which the device is to be erected corresponds to a generally horizontal position of the platform member, and contact between the leg member and the internal surface of the aperture corresponds to a position of the leg member which is upright but inclined to the vertical. The leg member contacts the internal surface of the aperture at its upper end and the floor of the room at its lower end. The contacts between the upper and lower ends of the leg member and the internal surface of the aperture and the floor, respectively, and the contact between the platform member and the wall or walls cooperate to maintain the platform member in a stable generally horizontal position abutting against the wall or walls. The aperture is of a shape and size allowing the positioning of the leg member or members al a desired angle or angles to the platform member.

18 Claims, 12 Drawing Sheets

STAND DEVICE

This is a U.S. national phase application under 35 U.S.C. §371 of International Patent Application No. PCT/GB02/00060, filed Jan. 9, 2002. The International Application was published in English on Jul. 18, 2002 as WO 02/054909 A1 under PCT Article 21(2).

This invention relates to a shelf or stand device, and is particularly concerned with shelves or stand devices which allow the devices to be load bearing when positioned, for example, within an internal corner between two adjacent walls of a room in a house.

Most wall shelves are attached to a wall by means of brackets or like supports, which are fixed to the walls, e.g., by screws. The walls have to be drilled and plugged to receive the screws. Apart from the time needed to achieve the requisite stable fixing, if the shelf is later removed with its bracket, the original screw holes in the walls are unsightly and must be stopped up. Making good and redecoration are, therefore, then frequently needed.

Stands have also been known for many years in which one or more shelves form an integral part of an upright leg which has a plurality of feet at its base to provide adequate support. Such stands are, however, often unstable and unsuitable for use as shelves.

We have sought to overcome the disadvantages of the shelf or stand devices of the prior art just referred to.

The invention consists in a shelf or stand device comprising at least one platform member and at least one rod like elongated leg member, an aperture in said platform member being shaped to allow the passage therethrough of said leg member, contact between said leg member and the internal surface of said aperture corresponding to a generally horizontal position of said platform member, and to a position of said leg member upright but inclined to the vertical, contacting said internal surface of said aperture at the upper end of said leg member and contacting at its lower end the floor of the room in which said device is erected, the contacts between said upper and lower ends of said leg member or members and the corresponding internal surface or surfaces of said aperture or apertures and the floor, respectively, maintaining, or co-operating to maintain, said platform member or members in a stable generally horizontal position.

When said device is to be used free-standing, a single leg member may be provided at its lower end with a supportive base or foot, or at least two leg members may be provided which have lateral supports at their lower ends.

The invention further consists in a shelf or stand device comprising at least one platform member and at least one rod-like elongated leg member, an aperture in said platform member being shaped to allow the passage therethrough of said leg member, contact between said platform member and an adjacent wall or walls corresponding to a generally horizontal position of said platform member and contact between said leg member and the internal surface of said aperture corresponding to a position of said leg member upright but inclined to the vertical, contacting said internal surface of said aperture at the upper end of said leg member, and contacting at its lower end the floor of the room, the contacts between said upper and lower ends of said leg member and said internal surface and floor respectively, and the contact between said platform member and said wall or walls cooperating to maintain said platform member in a stable, generally horizontal position abutting against said wall or walls, said aperture being of a shape and size allowing positioning of the leg member or members at a desired angle or angles to the platform member.

In a preferred form of the device, which is adapted for use in a corner between adjacent walls of the room, edge-portions of the platform member are shaped and adapted to abut against adjoining portions of said adjacent walls when said device is in use, whereby a stable set-up is achievable with one leg only.

Alternatively, in a less preferred form of the device, which is adapted for use against one wall of the room, at least two leg members are provided and edge portions of said platform member abut against adjoining portions of the wall when the device is in use providing stability to the supported platform member. Where one leg member or a pair of leg members is/are used in a free-standing device, the lower end of the single leg member for example may be provided with an appropriate base, or the leg members of the pair are each provided with an appropriate base or like support eg., a pair of suitable feet in order to confer stability to the device. In the alternative, instead of one or a pair of legs, three or more legs may be used for such free-standing devices.

A plurality of platform members may be used which are capable of being detachably connected to each other to form a single platform.

In another feature of the device, the upper end of the, or each, leg is reduced in diameter to allow ready adjustment of the positioning of the leg within the corresponding aperture to a desired angle between the leg and the platform, and a fixing means is provided on the platform to allow the leg to be detachably fixed in position.

The invention covers the shelf or stand device both when assembled in a room and, as a kit of parts, when disassembled.

As can be seen from the above, the device of the invention is readily assembled in position within a room. In spite of the ease of assembly and disassembly, the device of the invention provides a stable platform in use. Furthermore, added weight upon the platform member wedges the latter more securely in position by increasing the forces applied to the wall or walls by the corresponding edge portions of the platform member, and applied by the leg member to the internal surface of the aperture and the floor, respectively, whereby the platform member is wedged more securely in position.

The stability of the device of the invention is achieved without the need to fix a bracket or like support to the wall or walls as is the case with the shelf or stand devices of the prior art.

In its simplest form, the platform member may be a metal plate which is generally triangular in shape with an aperture formed near one apex of the plate to receive the leg member (see e.g. FIG. 4 of the accompanying drawings).

The platform member may, however, be a composite of a shelf and a metal plate fixed to the shelf.

Figure 1:
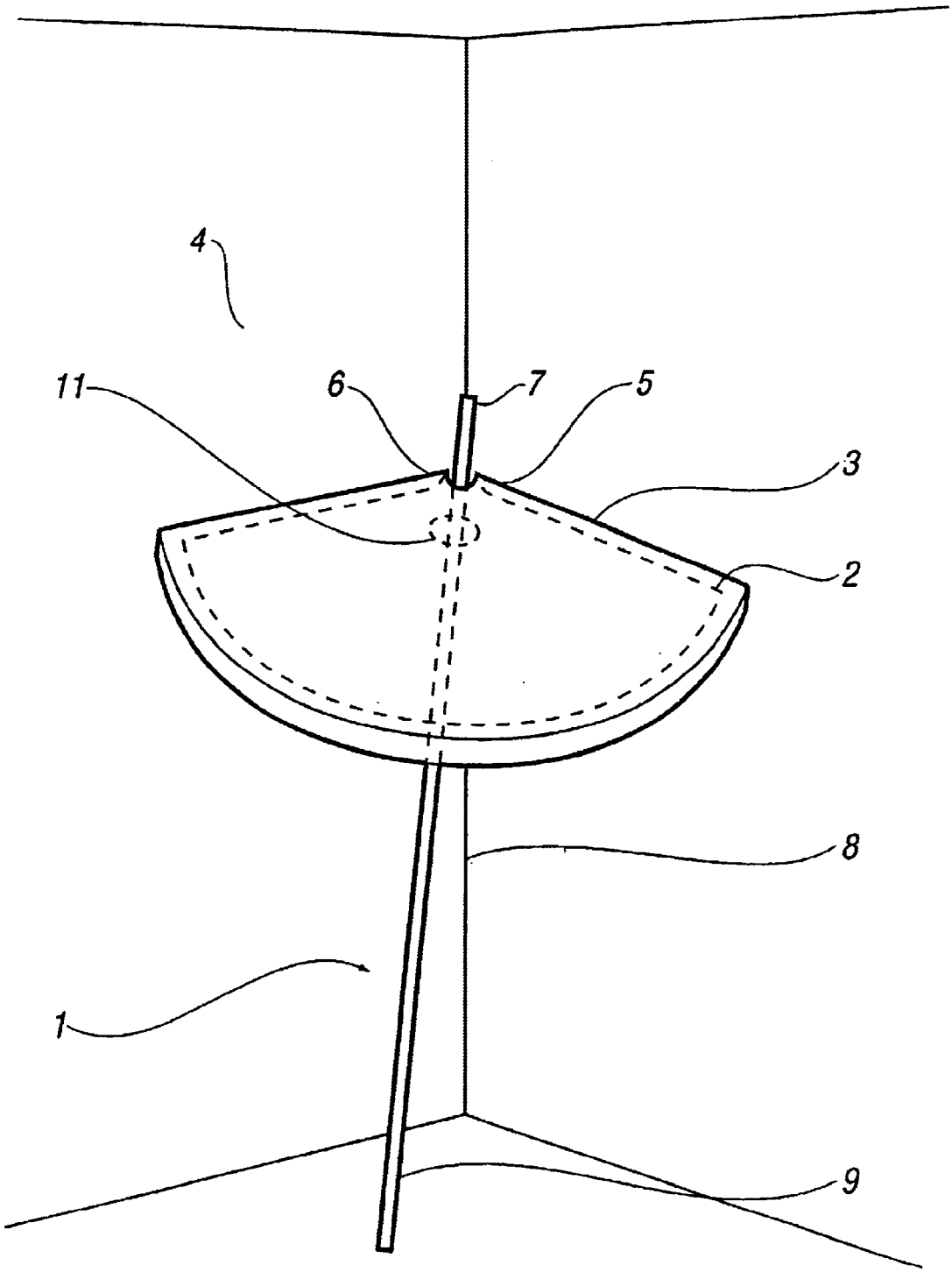
FIG. 1 shows the shelf of the instant invention.
Figure 4:
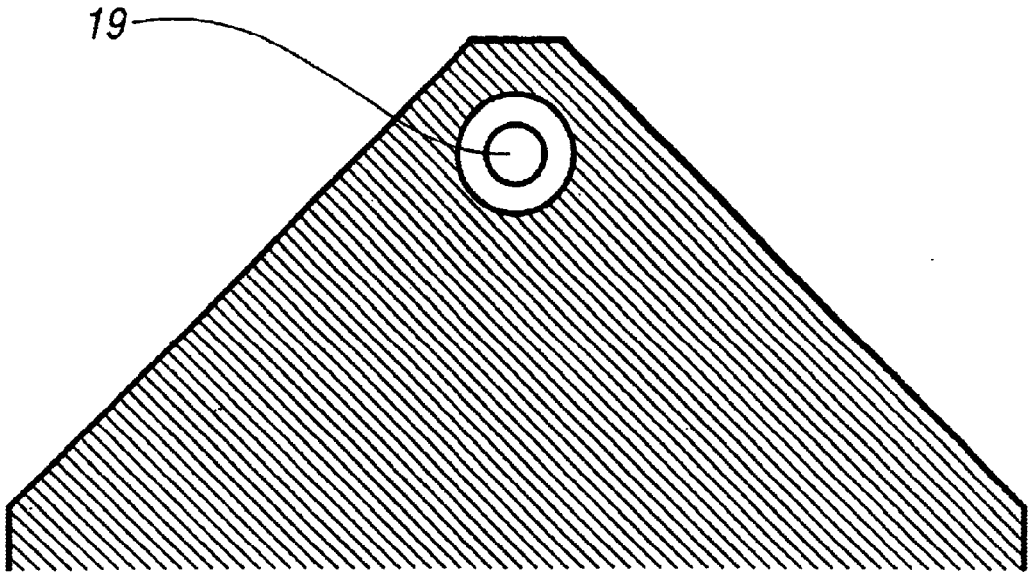
FIG. 4 shows the grommet.

Reference is now made to FIG. 1 of the drawings. A metal plate 2 similar in shape to that shown in FIG. 4 of the drawings is fixed to the underside of a shelf 3 which is also generally triangular in shape. The edges 5 and 6 of the shelf 3 are in contact with the walls 4 at the corner 8 of a room. A leg 1 in a generally upright position but inclined to the vertical passes through an aperture 11 in the plate 2 at the upper end 7 of the leg 1, adjacent to a notch 18 (see FIG. 2 of the drawings) in the shelf 3. The lower end 9 of the leg 1 rests on the floor 10 of the room.

FIG. 1 as just described shows the device adapted to, and positioned in, the corner of a room defined between two walls of the room.

It should be noted that, where a free-standing device is to be used, ie., a device resting on the floor of a room via one or more legs without relying on the support of a wall or walls, and the device has only one or two legs as opposed to three or more, the lower end or ends of the leg or pair of legs needs, or need, to be extended into a base or foot or otherwise given lateral support as indicated above. Such constructions are believed to be readily apparent to the skilled person in the art to which this invention appertains, and are, therefore, not illustrated or further described.

To assemble the shelf device and place it in position, the leg 1 is passed at one end 7 through the aperture 11 in the plate 2 adjacent to the corresponding notch 18 in the shelf 3. The assembled device is placed in the corner 8 of the room with the leg 1 generally upright but inclined to the vertical and the sides 5, 6 of the shelf 3 in contact with the walls 4 of the room, so that the shelf 3 is in a generally horizontal position. The leg 1 then presses against the internal surface of the aperture 11 and the surface of the floor 10, and the sides 5, 6 of the shelf 3 are held against the walls 4 of the room so that the shelf 3 is maintained stably horizontal against the walls.

Whereas a considerable advantage of the invention is its simplicity and its ease of assembly and disassembly, the device of the invention is not limited to a single platform member and/or a single supporting leg member. Thus, the invention can be readily adapted to a device having a plurality of platform members in tiers which operates in precisely the same way as the simplest form involving only one platform member and one leg member (see FIG. 2). Thus, in a tiered device, each platform member may be provided with one or more apertures depending on the number of leg members. Alternatively, a single platform member may be provided with a plurality of apertures to receive a corresponding number of leg members.

Figure 2:
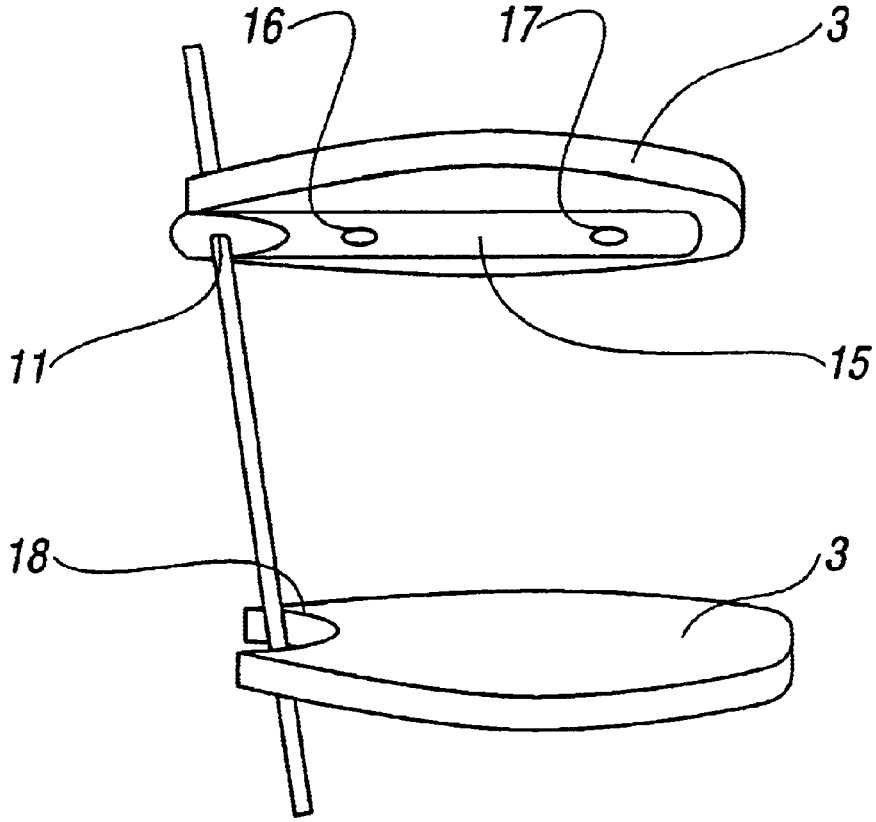
FIG. 2 shows the invention having tiered platform members.

FIG. 2 also illustrates a construction in which the aperture 11 is formed in a strap-shaped plate 15 corresponding to the triangular plate 2 of FIG. 1. The shelf 3 is screwed to the plate 15 at 16 and 17. The notch 18 in the shelf 3 is also clearly shown.

Figure 3:
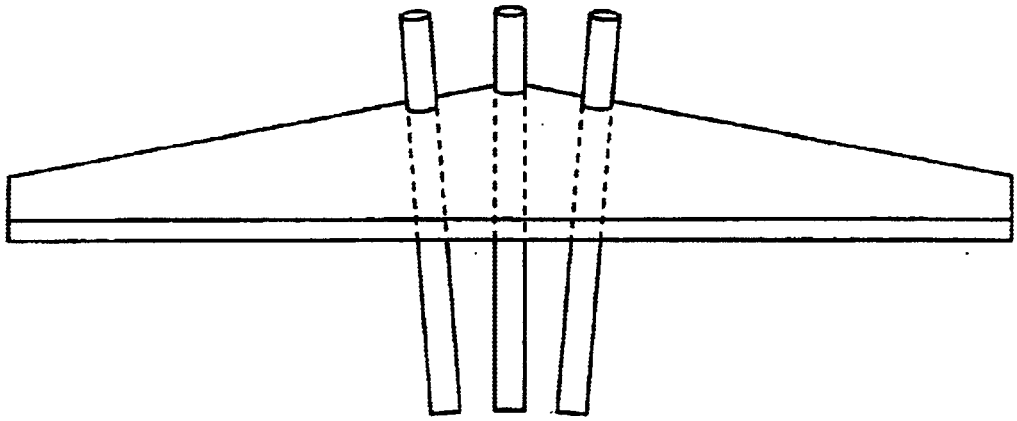
FIG. 3 shows the invention having a plurality of legs.

Reverting to the simplest form of the invention involving only one platform member and one leg member, respectively, the load bearing capacity of the device is limited only by the strength of its components and their dimensions and the stability of the corner in which the device is used. In a specific example, where the platform member is composed of 3 mm thick steel plate and the leg member consists in a solid cylindrical metal rod of 750 mm in length and 10 mm in diameter, the device stably supports a load of 20 kg. Where a higher shelf is needed, the correspondingly longer leg may be given greater strength by appropriate choice of material or change in dimensions, or both. Alternatively, the single leg device may be modified as indicated above to have more than one leg element to the leg extending through corresponding apertures in the platform or platforms. Thus double or triple element legs have been found useful (see FIG. 3 of the accompanying drawings). The load bearing capacity of the device of the invention depends inter, alia on the relationship between the leg length and its thickness in addition to the choice of material for the leg, and on whether the leg is solid or is, e.g., a hollow tube. Similarly, the device depends on the innate strength of the material of the platform and on the thickness of the platform in relation to its surface area. Further limiting or defining factors involve the dimensions of the aperture which receives the leg or each leg element comprised in the device.

Because the angle between the leg and platform varies according to the leg length or shelf depth, it is necessary to alter the hole size or the leg diameter in order to achieve the correct angle. Instead of producing a range of platforms with different sized holes, and a range of legs of different diameters, the same effect can be achieved by drilling a standard oversized hole in the platform, and then reducing it to the required size with a grommet or bush (see the grommet 19 in FIG. 4) or by sleeving the leg to create an appropriate diameter, thus achieving the correct angle between leg and platform and simplifying production.

In general, the lower end of the leg should be in contact with the floor of the room at or near the planar trace of the front or leading edge of the horizontal platform. The angle between the leg and the platform varies accordingly with leg length and platform depth. Thus, for a given depth of platform, different heights of platform require different lengths of leg. A higher platform requires a longer leg, and a position of the leg in which its lower end rests on the floor at the planar trace of the front edge of the horizontal platform corresponds to a wider angle between the platform and the leg. Thus, for a given depth of platform, the angle between the leg and the platform needs to be greater for a 750 mm leg length than for a 500 mm leg length to provide a stable arrangement whilst avoiding that the leg should protrude unduly forwards and be a possible hazard. In other words, the larger angle corresponds to a position of the lower end on the floor of the room at the planar trace of the front or leading edge of the platform. Conversely, at a given height, a deeper platform requires a longer leg to reach the planar trace of the leading edge, and, in that position of the leg, the leg forms a smaller angle with the platform. Thus, for example, at a given height, the said angle is smaller for a 300 mm platform depth than for a 200 mm platform depth. It should be noted that the greater the inclination of the leg away from the vertical, or the smaller the angle between the inclined leg and the horizontal platform, the larger the aperture in the platform needed to receive the leg. Thus, at the aperture, the greater the said inclination, the greater the horizontal cross-section of the leg.

A feature of the invention is that with the use of grommets or bushes in the apertures (see the grommet 19 in FIG. 4) or sleeves on the legs, the sizes of the apertures in the platforms and the leg diameters can be standardised. This permits the use of different leg lengths as well as different shelf depths without the need to manufacture a range of platforms with different aperture sizes, and obviates the need to supply legs of various diameters.

Figure 5:
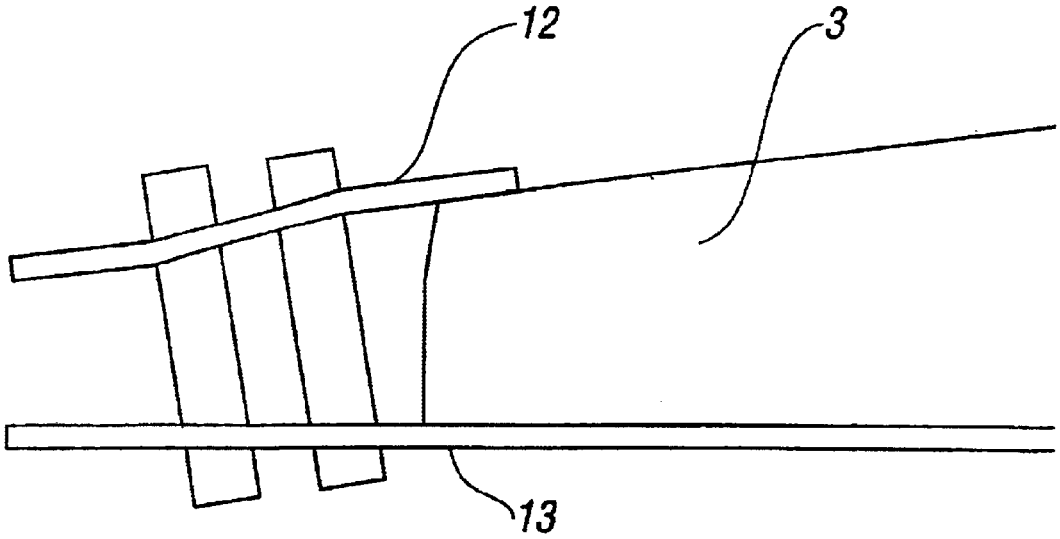
FIG. 5 shows a shelf clamp.

A shelf clamp 12 (see FIG. 5 of the accompanying drawings) may be mounted on the leg in the same way as the platform proper 13, whereby the shelf 3 is clamped between the clamp 12 and the platform 13. This may still allow for mixing and matching as discussed above, subject to the additional component of an upper support provided by the clamp 12. The shelf 3 is thus sandwiched in position without external fixing means or adhesives but is still readily replaceable by a different shelf.

Figure 6:
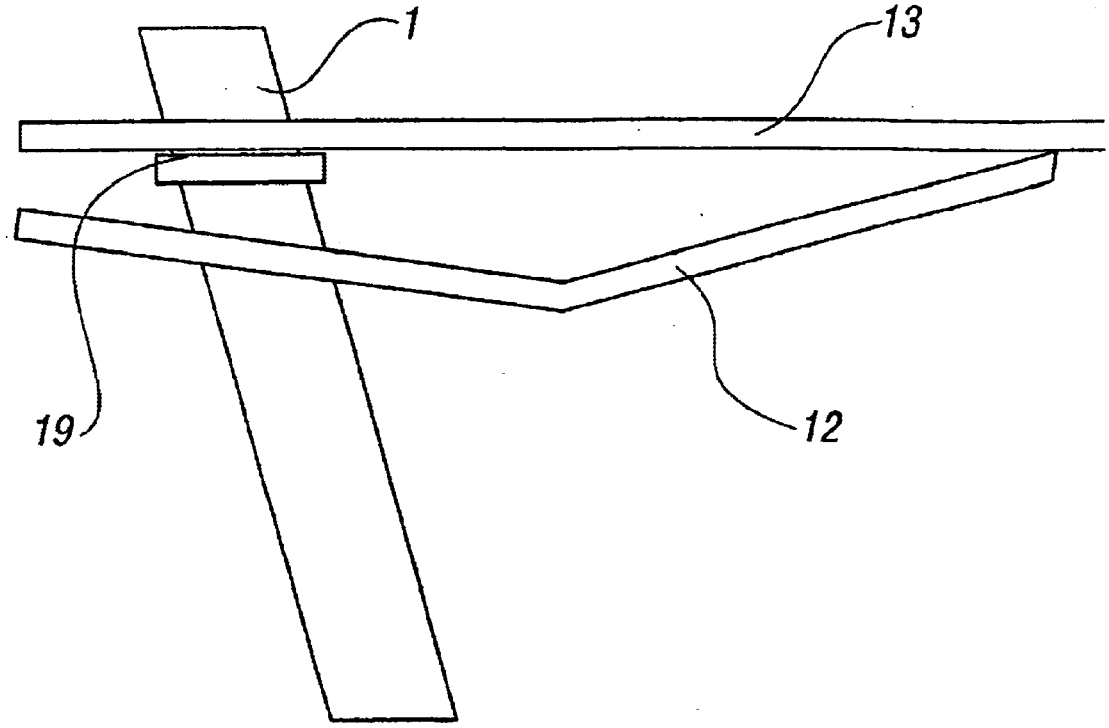
FIG. 6 shows a construction in which the clamp is positioned below the plate.

FIG. 6 shows a construction in which the clamp 12 is positioned below the plate 13 to support the plate directly. The plate 13 may act alone as a platform member or a shelf 3 (not shown) may repose on the plate, and if required be fixed to the plate.

Figure 7:
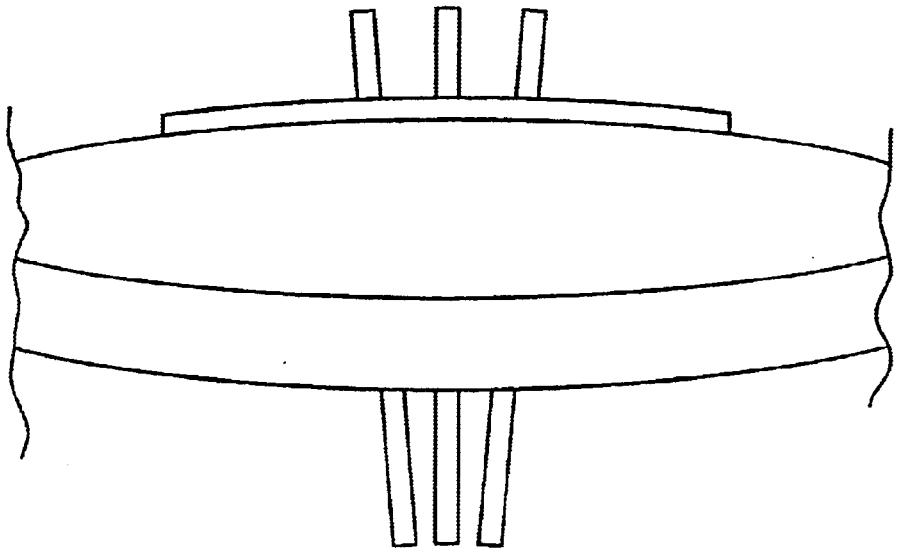
FIG. 7 shows the use of additional legs.

As suggested above, additional leg members (i.e., a triple element leg construction) may be accommodated by additional platform apertures, to increase leg strength over a greater leg length and, additionally, to offer alternative design options (see FIG. 7 of the accompanying drawings). This construction may be thought of as the equivalent of a single leg split into three leg elements.

Figure 8:
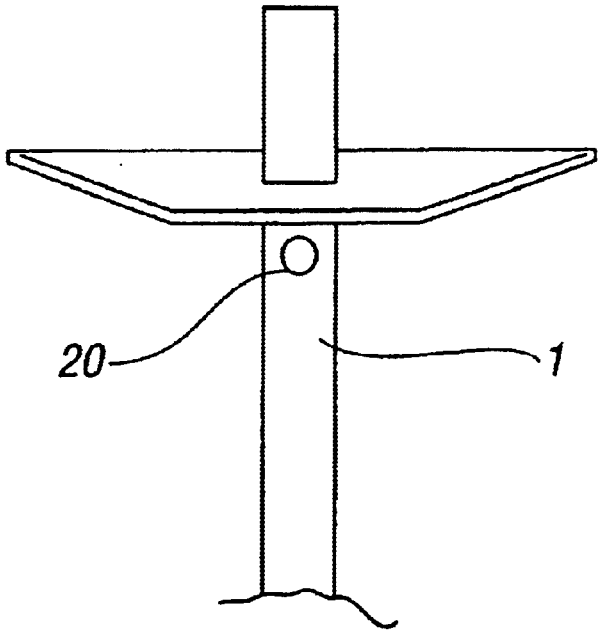
FIG. 8 shows a nipple or snagging member.

A nipple or a snagging member 20, i.e., a burr of welding or soldering material, may be provided on the leg 1 to snag the corresponding aperture (not shown) in the platform 2 in order to retain the platform at a stable height when not under load (see FIG. 8 of the accompanying drawings). In the alternative, the upper end of the leg 1 may be reduced in diameter to provide a shoulder which retains the platform 2 at the desired height. The construction of this modification is again believed to be well within the compass of the skilled person in the art to which this invention appertains, and is therefore not illustrated.

Figure 9:
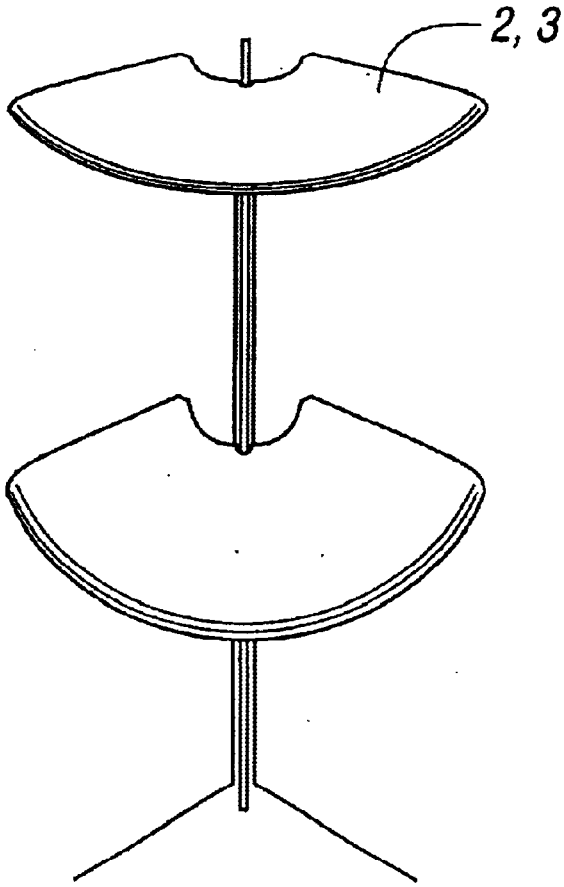
FIG. 9 shows additional platforms.

The addition of extra platforms 2, 3 (see FIG. 9 of the accompanying drawings) allows the device of the invention to act as a multi-tiered shelf or stand device.

Figure 10:
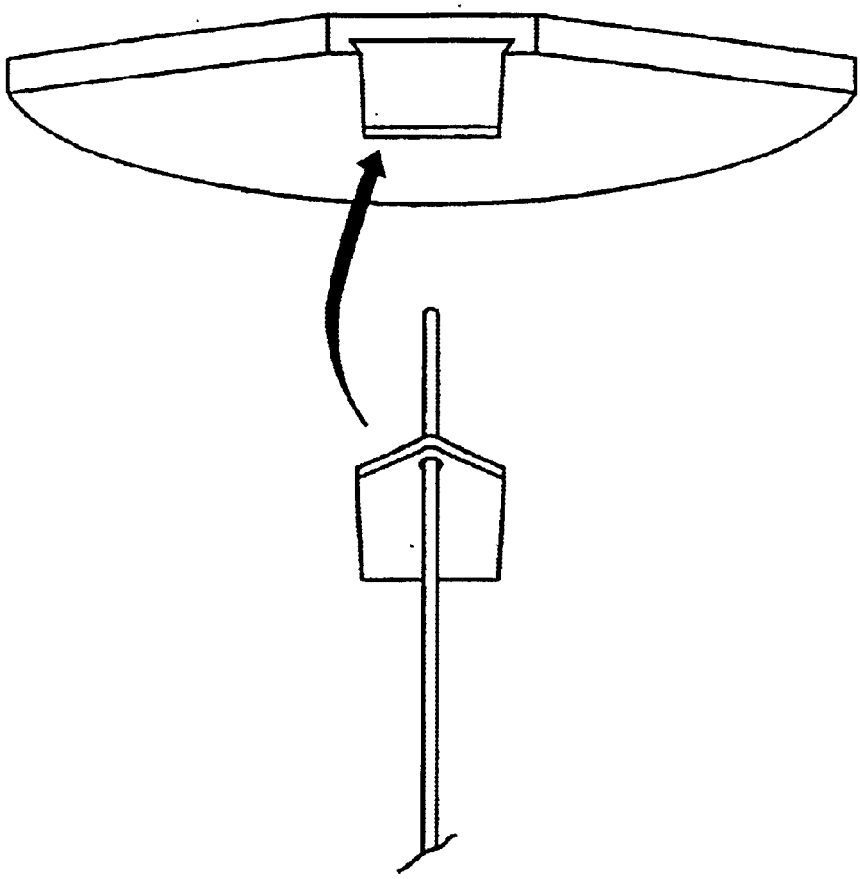
FIGS. 10 and 11 show a method of attaching the plate to the shelf.
Figure 11:
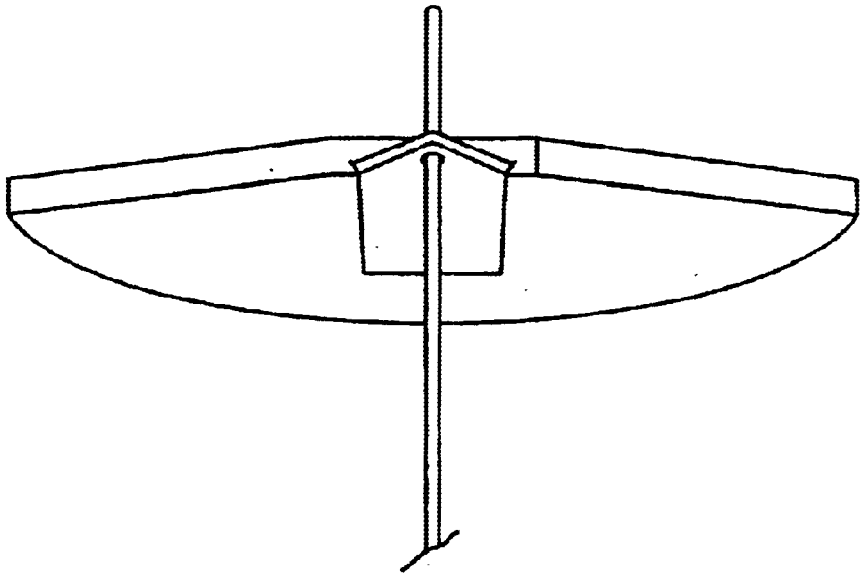

FIGS. 10 and 11 show a different method of attaching the plate to the shelf. FIG. 10 is a view from beneath and behind the stand device.

Figure 12:
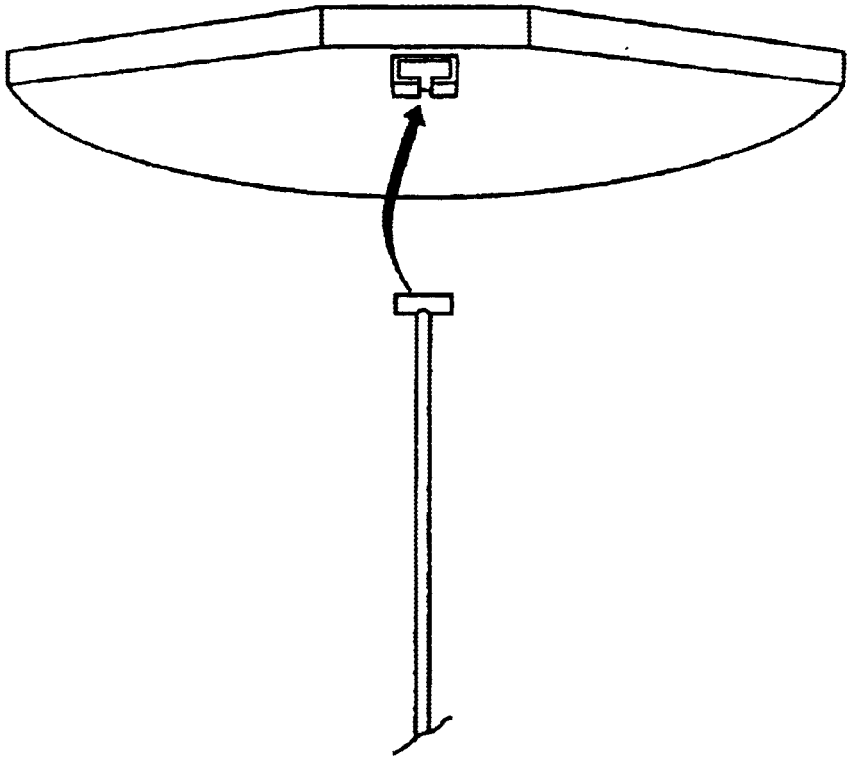
FIG. 12 is a view similar to FIG. 11 but showing a different method.

FIG. 12 is a view similar to FIG. 11 but showing a different method of attachment of the leg member, again seen from beneath and behind.

Figure 13:
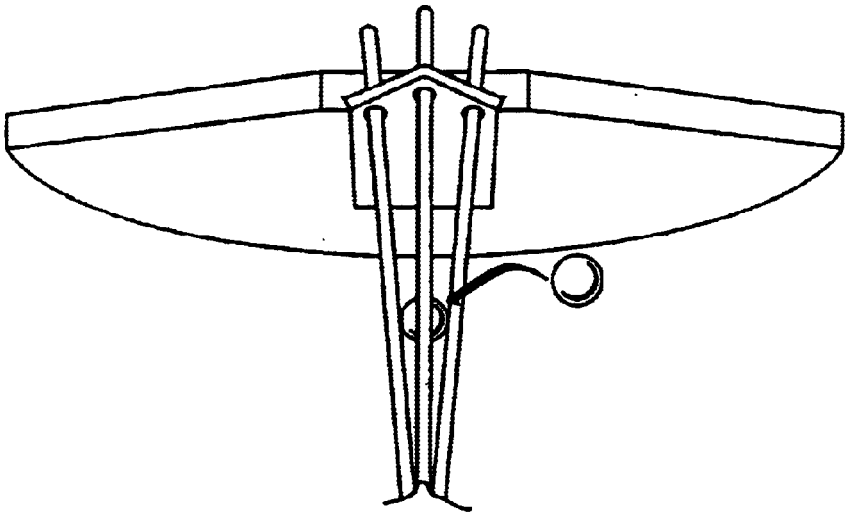
FIG. 13 shows a three legged device.

FIG. 13 shows a three leg device given extra rigidity by means of a steel bearing wedged between the legs, thus allowing for increased load bearing. Any appropriate rigid material may be used for the bearing as an alternative to steel.

Figure 14:
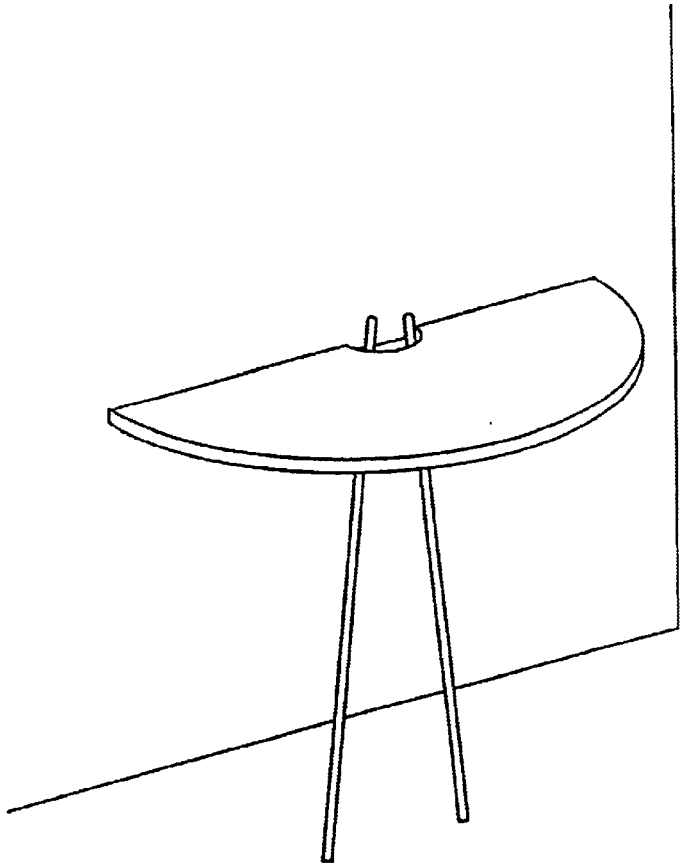
FIG. 14 shows a two legged wall standing device.

FIG. 14 shows a two legged wall-standing device similar to that shown in FIG. 1.

Figure 15:
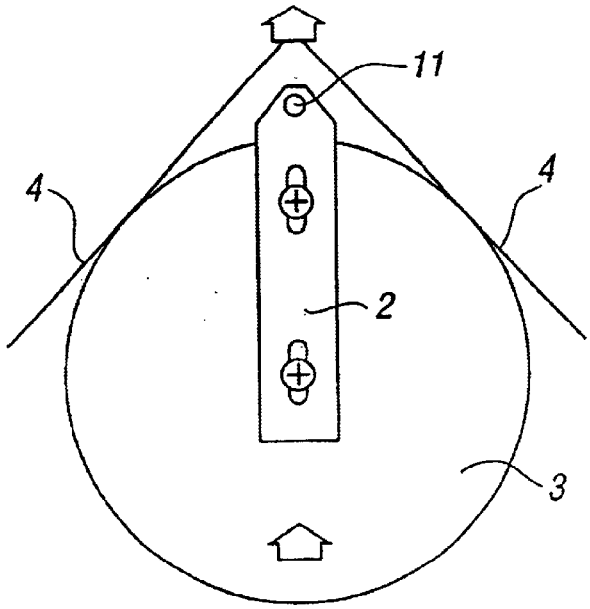
FIG. 15 shows a slotted plate.

FIG. 15 shows a slotted plate which allows repositioning to render a circular shelf secure in a corner. This illustrates the fact that the device of the invention is not limited to polygonal shelves or plates but may comprise a circular shelf as shown.

Figure 17:
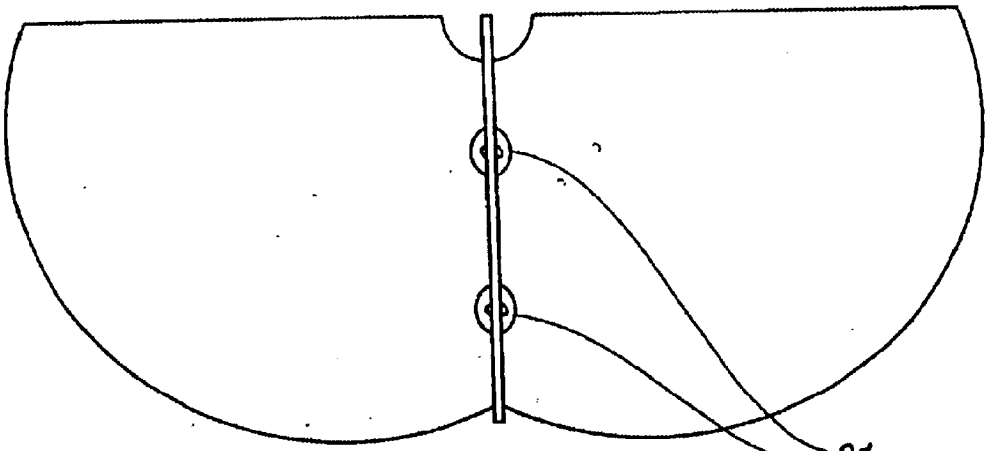
FIGS. 16, 17, 18 show a construction in which two corner units are joined.
Figure 18:
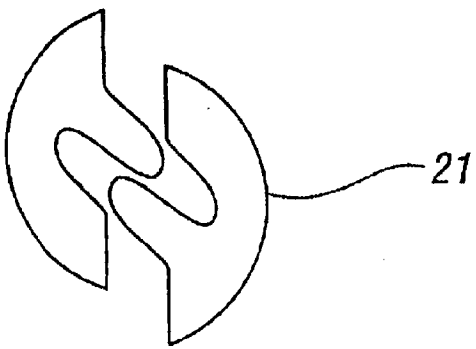
Figure 16:
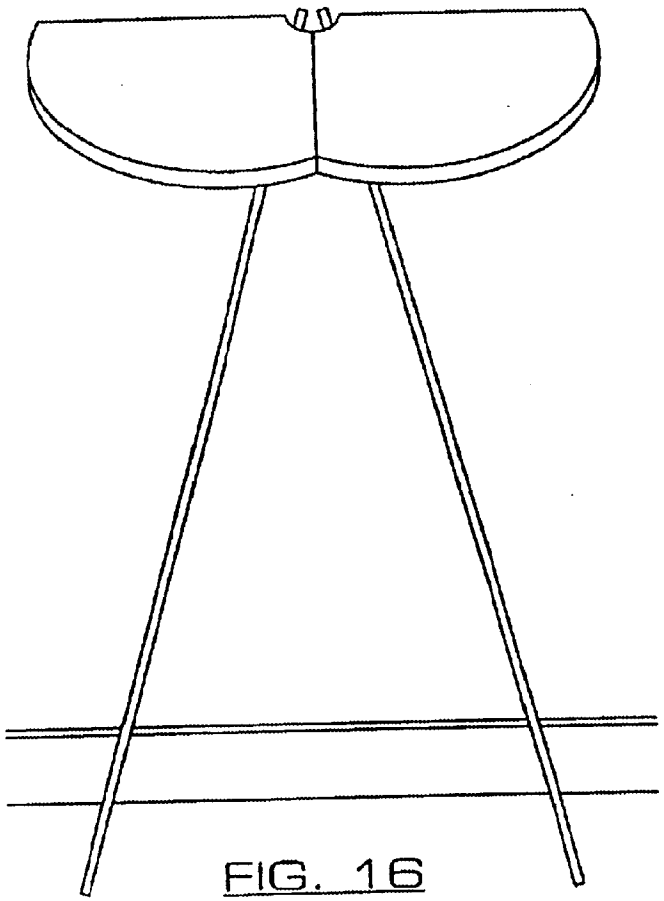

FIGS. 16–18 show a construction in which two corner units are joined together at 21 (see detail in FIG. 18), using so called "knockdown fittings", which interlock with one another, to provide a wall stand capable of acting as a console table. Only two legs are needed.

Figure 19:
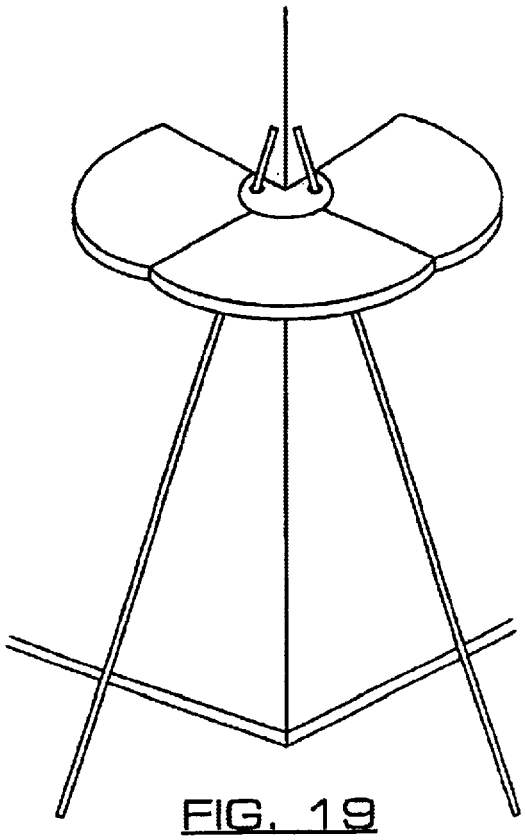
FIGS. 19, 20 show a device with three corner units.
Figure 20:
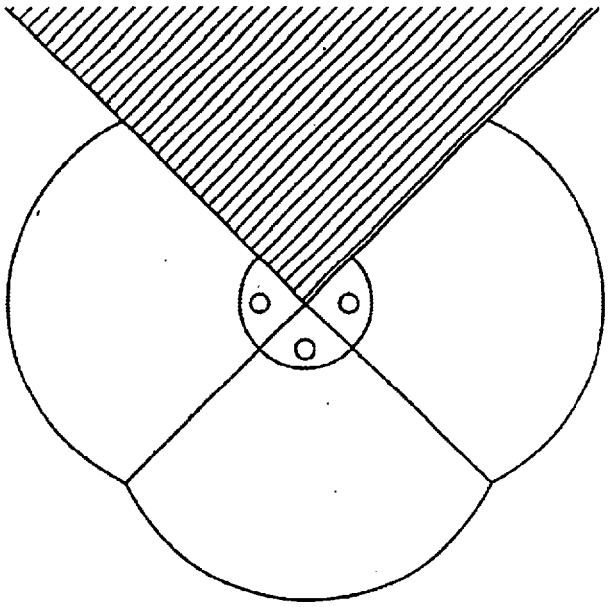

FIGS. 19–20 illustrate a device with three corner units adapted to fit around an external corner. Again, only two legs are needed. The device is also used as a wall stand or console.

Figure 21:
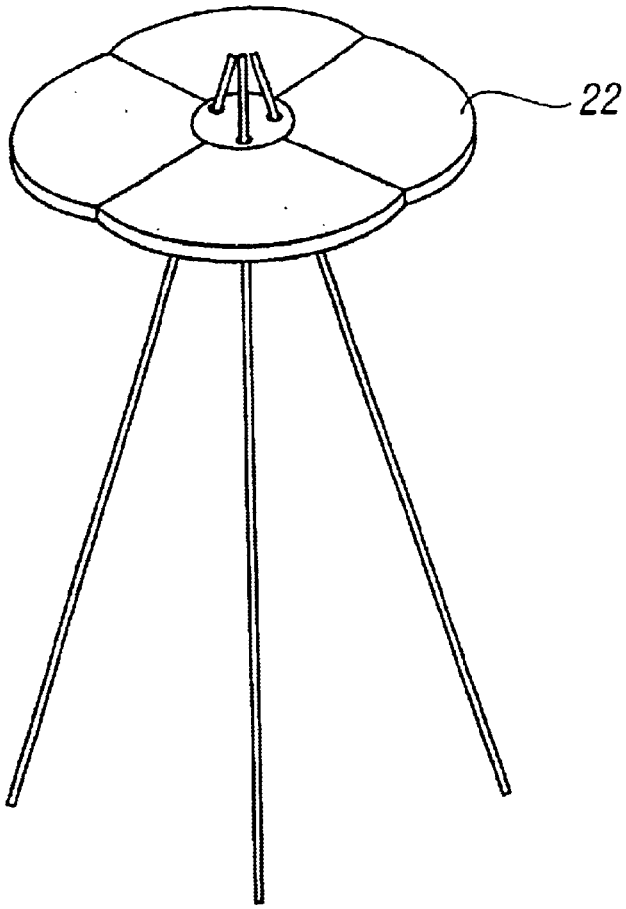
FIGS. 21, 22 show four corner units.
Figure 22:
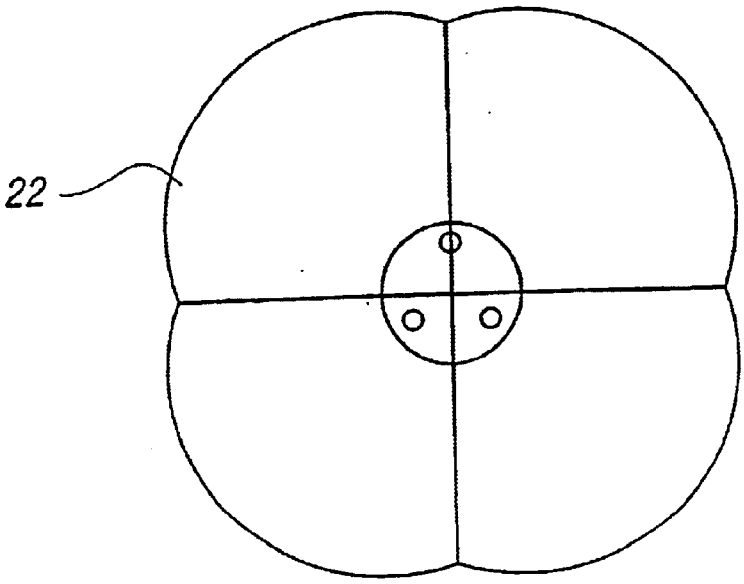

FIGS. 21–22 show four corner units joined together to form a top which is free-standing. Three legs are used but, as an alternative, a pair of legs each provided at its lower end with two or more supportive feet may be used instead. The device may be used as a free-standing occasional table. The four units 22 are locked together by suitable fastening means, eg., the fittings 21 shown in FIGS. 17–18. Alternatively, a unitary platform acting as a shelf or table top may be used instead of units 22, and provided with three or four leg members.

Figure 24:
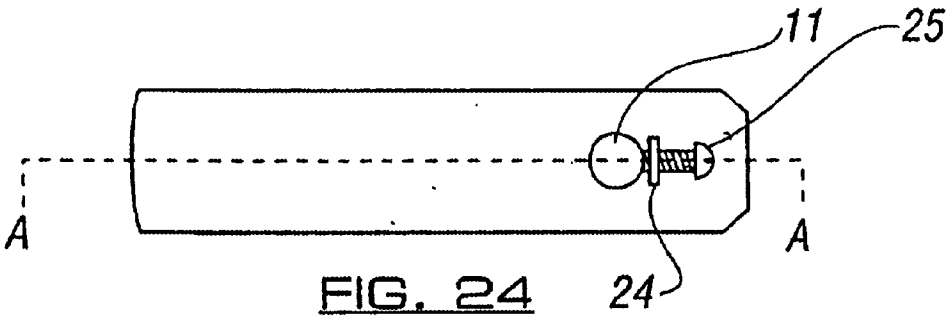
FIGS. 23, 24, 25 show the legs detachably fixed.
Figure 25:
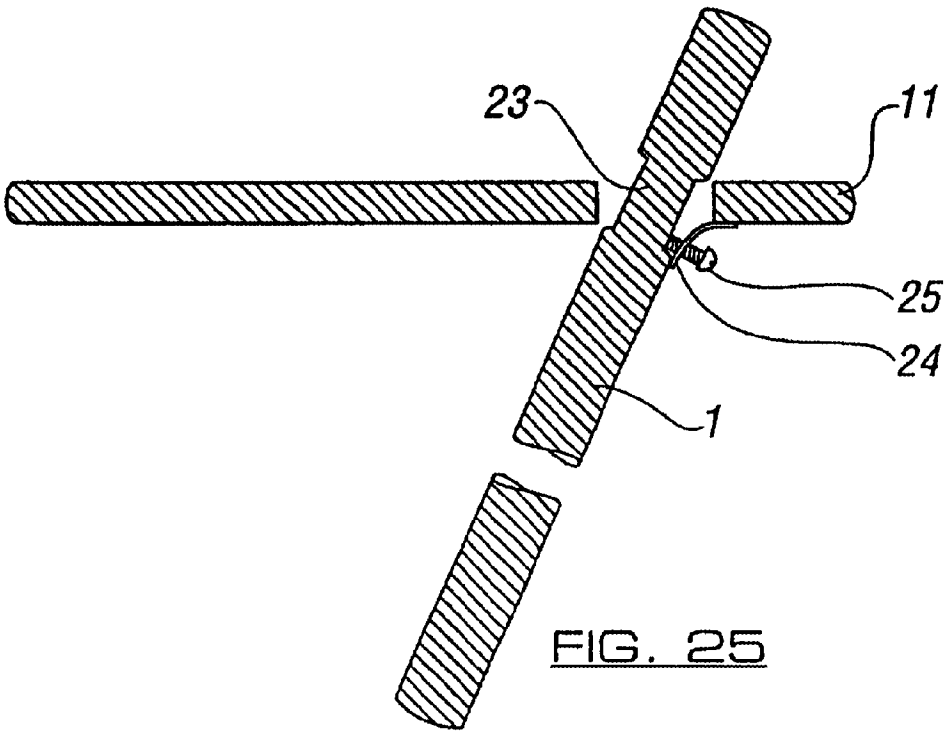
Figure 23:
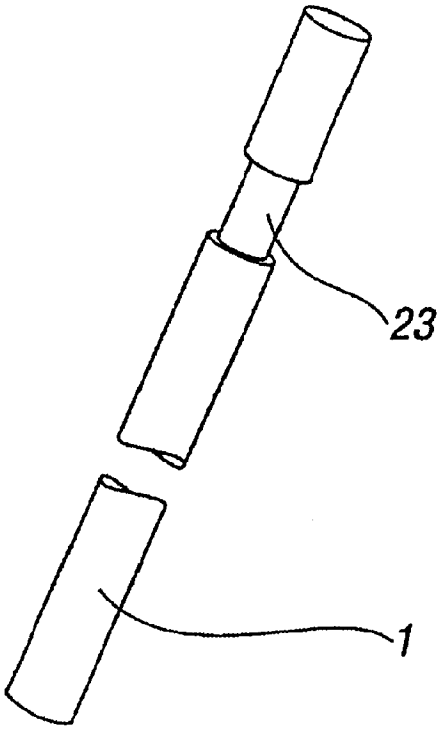

FIGS. 23–25 illustrate the case in which the leg or legs 1 is, or are, detachably fixed in position so that the leg 1 is locked to the plate 2 at a predetermined angle, and is thereby prevented from falling off when the assembled device is lifted up by its top. One way of achieving such convenient fixing of the leg 1 is to reduce the diameter of the leg at its intended upper end 7, as shown at 23 in FIG. 23, to permit movement of the leg 1, after insertion into the corresponding aperture in the plate 2, in order to achieve the required angle of inclination of the leg 1 to the plate 2. FIG. 24 shows the plate 2 in plan viewed from beneath the plate. A bracket 24 is fixed to the underside of the plate 2 adjacent to the aperture 111 of the plate. The bracket 24 is pierced to allow a screw member 25 to pass through and be supported by the bracket 24. The screw 25 is tightened against the reduced diameter upper portion 23 of the leg 1 to fix the leg in position (see FIG. 25, which is a cross-section at A—A of the plate 2 shown in FIG. 24).

As will be clear from the above, all kinds of shapes and sizes of aperture or apertures in the platform member or members and of corresponding shapes and cross-sectional areas of leg member or members may be chosen to achieve the desired angle of positioning of the or each leg member within its aperture relative to the platform member, a close fit of the leg member within its aperture being generally avoided.

What is claimed is:

1. A stand device comprising at least one platform member and at least one rod like elongated leg member, an aperture in said platform member receiving said leg member therethrough, wherein contact between said platform member and an adjacent wall or walls of a room in which said device is to be erected corresponds to a generally horizontal position of said platform member and contact between said leg member and an internal surface of said aperture corresponds to a position of said leg member upright but inclined to the vertical, contacting said internal surface of said aperture at the upper end of said leg member, and contacting at its lower end the floor of the room, and wherein the contacts between said upper and lower ends of said leg member and said internal surface and floor, respectively, and the contact between said platform member and said wall or walls co-operate to maintain said platform member in a stable generally horizontal position abutting against said wall or walls, said aperture being of a shape and size allowing positioning of the leg member or members at a desired angle or angles to the platform member, provided that, when said device is to be erected against a single wall, at least two of said leg members are employed.

2. A device according to claim 1, wherein edge portions of said platform member are shaped to complement an inside corner of a room, whereby, when the device is in use, the edge portions of said platform abut against adjoining portions of adjacent walls defining the inside corner of the room, thereby achieving a stable set-up with one leg member only.

3. A device according to claim 1, adapted for use against one wall of a room, wherein at least two leg members are provided, and edge portions of said platform member abut against adjoining portions of said wall when the device is in use providing stability to the supported platform member.

4. A device according to claim 1, comprising a plurality of platform members detachably but fixedly connected to each other to form a single platform.

5. A device according to claim 1, comprising a plurality of platform members in a tiered relationship with one another when the device is in use, each platform member having one or more apertures capable of accommodating the leg member or members employed.

6. A device according to claim 1, comprising a single platform member provided with a plurality of apertures for receiving a corresponding number of leg members.

7. A device according to claim 1, in which at least one standard oversized aperture is provided in a single platform member, and said aperture or apertures is, or are, reduced in size to receive the corresponding leg or legs by means of a grommet or bush, or, in the alternative, the leg or legs is, or are, sleeved to leg diameter that achieves a desired angle between the leg or legs and the platform.

8. A device according to claim 1, wherein a shelf clamp is mounted on the, or each, leg member such that a shelf member may be clamped between said clamp and a platform member also mounted on said leg member, said shelf member being readily replaceable by a shelf member of a different size.

9. A device according to claim 1 wherein a clamp member is positioned on said leg member below a platform member to support said platform member directly, said platform member acting alone as a shelf; member or supporting a shelf member which, if required, may be detachably fixed to said platform member.

10. A device according to claim 1 wherein a nipple or shoulder is provided on the, or each, leg member to support the mouth of the corresponding aperture in the corresponding platform member, whereby, in use, said platform member is retained at a stable height.

11. A device according to claim 1, having a single composite or unitary platform member, three legs received in a corresponding aperture or apertures formed within said platform member, and a bearing composed of a rigid material wedged between said legs when the device is in use.

12. A device according to claim 1, in which said platform member is slotted to allow repositioning in use, whereby, a shelf member supported by said platform members may be stably secured in a corner defined between adjacent walls of a room.

13. A device according to claim 1, in which the upper end of the, or each, leg member is reduced in diameter to position said leg member within said aperture of said platform member at a desired angle between said leg member and said platform member, and a fixing means is provided on said platform member to detachably fix said leg member in a position corresponding to said desired angle between said leg member and its corresponding platform member.

14. A device according to claim 1, wherein, in use, the lower end of said leg member is in contact with the floor of the room at or near a planar trace of the front or leading edge of the horizontal platform.

15. A kit of parts for a stand device according to claim 1 comprising at least one platform member and at least one leg member capable of being assembled together to form a stand device.

16. A method of putting together a stand device according to claim 1, wherein at least one leg member is positioned in an upright position but inclined to the vertical with the upper end of said leg member passing through an aperture in a platform member in such manner as to contact the internal surface of said aperture, and the lower end of said leg member or members contacting the floor of the room in which said device is put together and erected, provided that, when said device is to be erected against a single wall, at least two of said leg members are employed.

17. A shelf or stand device comprising at least one single composite or unitary platform member, three rod like elongated legs received in a corresponding aperture or apertures formed within said platform member, and a bearing composed of a rigid material wedged between said legs when the device is in use, said legs connected at their upper ends to said platform member, wherein the connections between said legs and said platform member correspond to a generally horizontal position of said platform member, and to a position of said legs upright but inclined to the vertical, connected to said platform member at the upper end of said legs, and contacting at their lower ends the floor of the room in which said device is erected, and wherein the connection between said upper ends of said legs and said platform member and the contact between said lower ends of said legs and the floor, respectively, maintain, or co-operate to maintain, said platform member or members in a stable generally horizontal position.

18. A shelf or stand device comprising at least one platform member and at least one rod like elongated leg member, an aperture in said platform member receiving an upper end or ends of said leg member or members therethrough, the upper end of the, or each, leg member being reduced in diameter to position said leg member within said aperture of said platform member at a desired angle between said leg member and said platform member, and a fixing means on said platform member detachably fixing said leg member in a position corresponding to said desired angle between said leg member and its corresponding platform member, wherein the connection between said leg member and said platform member corresponds to a generally horizontal position of said platform member, and to a position of said leg member upright but inclined to the vertical, connected to said platform member at the upper end of said leg member, and contacting at its lower end the floor of the room in which said device is erected, and wherein the connection between said upper end or ends of said leg member or members and said platform member and the contact between said lower end or ends of said leg member or members and the floor, respectively, maintain, or co-operate to maintain, said platform member or members in a stable generally horizontal position.

* * * * *